US006705138B1

(12) United States Patent
Shen

(10) Patent No.: US 6,705,138 B1
(45) Date of Patent: Mar. 16, 2004

(54) CLUTCH MECHANISM FOR A LOCK

(76) Inventor: Mu-Lin Shen, No. 18, Gong-Yeh 3 Road, An-Nan District, Tainan (TW)

( * ) Notice: Subject to any disclaimer, the term of this patent is extended or adjusted under 35 U.S.C. 154(b) by 0 days.

(21) Appl. No.: 10/303,184

(22) Filed: Nov. 25, 2002

(51) Int. Cl.[7] ..... E05B 13/10
(52) U.S. Cl. ..... 70/224; 70/472; 292/336.3
(58) Field of Search ..... 70/221–224, 149, 70/218, 422, 472; 292/336.3

(56) References Cited

U.S. PATENT DOCUMENTS

| | | | | | |
|---|---|---|---|---|---|
| 3,604,229 | A | * | 9/1971 | Wake | 70/223 X |
| 4,424,691 | A | * | 1/1984 | Foshee | 70/224 |
| 5,598,726 | A | * | 2/1997 | Cordle | 70/224 |
| 5,768,926 | A | * | 6/1998 | Shen | 70/472 |
| 5,794,472 | A | * | 8/1998 | Kester et al. | 70/472 |
| 5,868,018 | A | * | 2/1999 | Kang | 70/472 |
| 5,992,189 | A | * | 11/1999 | McCaa | 70/149 |
| 6,014,878 | A | * | 1/2000 | Shen | 70/472 |
| 6,021,654 | A | * | 2/2000 | McCaa | 70/149 |
| 6,041,630 | A | | 3/2000 | Shen | 70/472 |
| 6,189,351 | B1 | * | 2/2001 | Eagan et al. | 70/472 |
| 6,216,500 | B1 | * | 4/2001 | Kang | 70/224 |
| 6,279,360 | B1 | * | 8/2001 | Shen | 70/224 |
| 6,351,976 | B1 | * | 3/2002 | Chen | 70/224 |
| 6,497,126 | B2 | * | 12/2002 | Wang | 70/472 |
| 6,575,006 | B1 | * | 6/2003 | Don | 70/472 |
| 6,615,630 | B2 | * | 9/2003 | Wu et al. | 70/472 |

* cited by examiner

*Primary Examiner*—Suzanne Dino Barrett
(74) *Attorney, Agent, or Firm*—Alan Kamrath

(57) ABSTRACT

An outside transmission assembly of a lock includes an outside spindle, an outside hub for rotatably receiving the outside spindle, a cam received in the outside spindle, a sleeve received in the cam, and a lug. The cam has an ear releasably engaged with a retractor. The lug has an arm and a ring formed on an end of the arm and mounted to the first end of the sleeve. The arm extends through the cam and the outside spindle. The cam and the outside spindle are turned jointly when the outside handle is turned. When the locking bar is moved to a locking position, the lug and the sleeve are moved away from the retractor. The cam is also moved away from the retractor such that the ear of the cam is disengaged from the retractor, allowing free rotation of the outside handle.

19 Claims, 6 Drawing Sheets

CLUTCH MECHANISM FOR A LOCK

BACKGROUND OF THE INVENTION

1. Field of the Invention

The present invention relates to a clutch mechanism for a lock. In particular, the present invention relates to a clutch mechanism for a lock that allows the outer handle to rotate freely when the lock is in a locked state so that the internal parts of the lock will not be damaged.

2. Description of the Related Art

A conventional door lock generally includes an outer handle and an inner handle respectively attached to the outside and the inside of a door so that the latch bolt can be retracted by turning either one of the outer handle and the inner handle. When in a locked state, the outer handle could not be turned for retracting the latch bolt. It is, however, not uncommon that the user still applies force to the outer handle to an extent that is normally sufficiently large enough for retracting the latch bolt if the user is not aware of the locked state of the lock. Thus, the inner parts of the lock connected to the handle could be damaged by a torque resulting from the force applied to the outer handle. The situation worsens for a lock with lever type handles.

U.S. Pat. No. 6,041,630 discloses a lock having a clutch mechanism to solve this problem. The lock includes an inner handle having a locking bar received therein and an outer handle connected to a spindle with a retaining base received therein which has two first grooves defined therein. A cam is connected to the retaining base and has two second grooves which communicate with the first grooves so that a locking piece is movably received between the retaining base and the cam with a spring biased between the locking piece and the retaining base. The locking piece has two flanges movably received in the first grooves and the second grooves. A slide is movably received in the cam and contact the locking piece at one end thereof and the locking bar at the other end thereof so that the two flanges of the locking piece are disengaged from the second grooves when the locking bar is pushed. Therefore, the outer handle can be freely rotated. Nevertheless, there are too many elements for the clutch mechanism. The assembly procedure is too complicated and the overall cost is increased.

SUMMARY OF THE INVENTION

An object of the present invention is to provide a clutch mechanism for a lock that allows easy assembly and that is easy to manufacture while allowing the outer handle to rotate freely when the lock is in a locked state so that the internal parts of the lock will not be damaged.

A lock mechanism in accordance with the present invention comprises:

a latch;

a retractor for retracting the latch;

an inside handle;

an inside spindle having a first end fixed to the inside handle to turn therewith and a second end, the inside spindle being operably connected to the retractor such that rotation of the inside spindle causes retraction of the latch;

a locking bar extending through the inside spindle and having a first end and a second end;

an inside hub for rotatably receiving the second end of the inside spindle;

an outside handle;

an outside spindle having a first end and a second end fixed to the outside handle to turn therewith, the first end of the outside spindle including a slot extending along a longitudinal direction of the outside spindle;

an outside hub for rotatably receiving the first end of the outside spindle;

a cam received in the first end of the outside spindle, the cam being movable relative to the outside spindle along a longitudinal direction of the outside spindle, the cam having an engaging notch, the cam further having an ear projecting outward therefrom, the ear of the cam being releasably engaged with the retractor such that rotation of the cam causes retraction of the latch;

a sleeve received in the cam and having a first end and a second end;

a lug having an arm and a ring formed on an end of the arm, the ring being so mounted to the first end of the sleeve that the sleeve is not turned when the arm is turned and that the arm and the sleeve are jointly movable along the longitudinal direction of the outside spindle, the arm extending through the engaging notch of the cam and the slot of the outside spindle, the cam and the outside spindle being turned jointly when the outside handle is turned; and an elastic element mounted between the outside handle and the cam for biasing the ear of the cam to engage with the retractor;

wherein when the locking bar is moved to a locking position, the lug and the sleeve are moved away from the retractor, the cam is also moved away from the retractor such that the ear of the cam is disengaged from the retractor, allowing free rotation of the outside handle without causing retraction of the latch.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
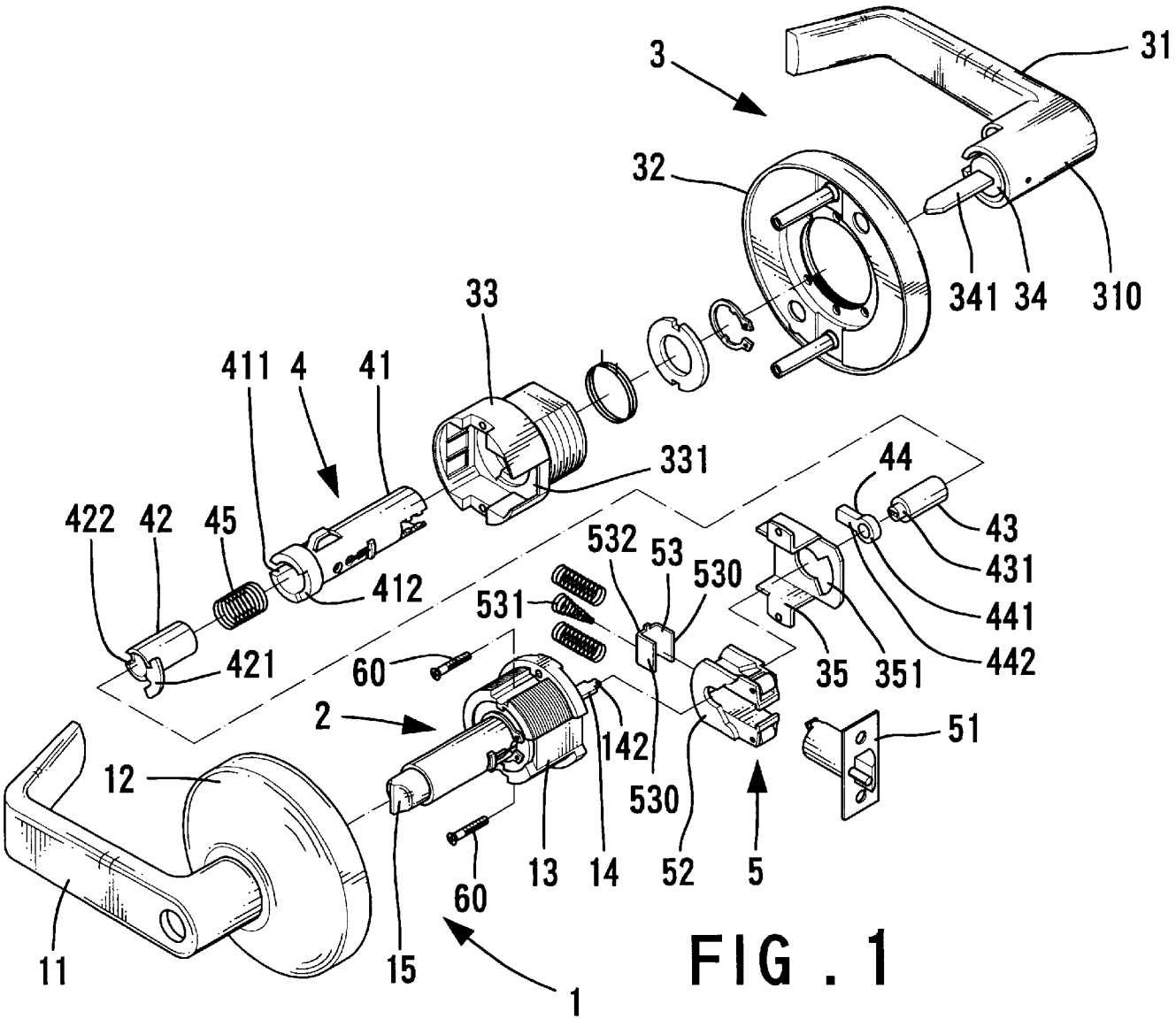
FIG. 1 is an exploded perspective view of a lock in accordance with the present invention.

Referring to FIG. 1, a lock in accordance with the present invention generally comprises an inside handle assembly 1, an inside spindle 2, an outside handle assembly 3, an outside transmission assembly 4, and a latch mechanism 5.

Figure 4:
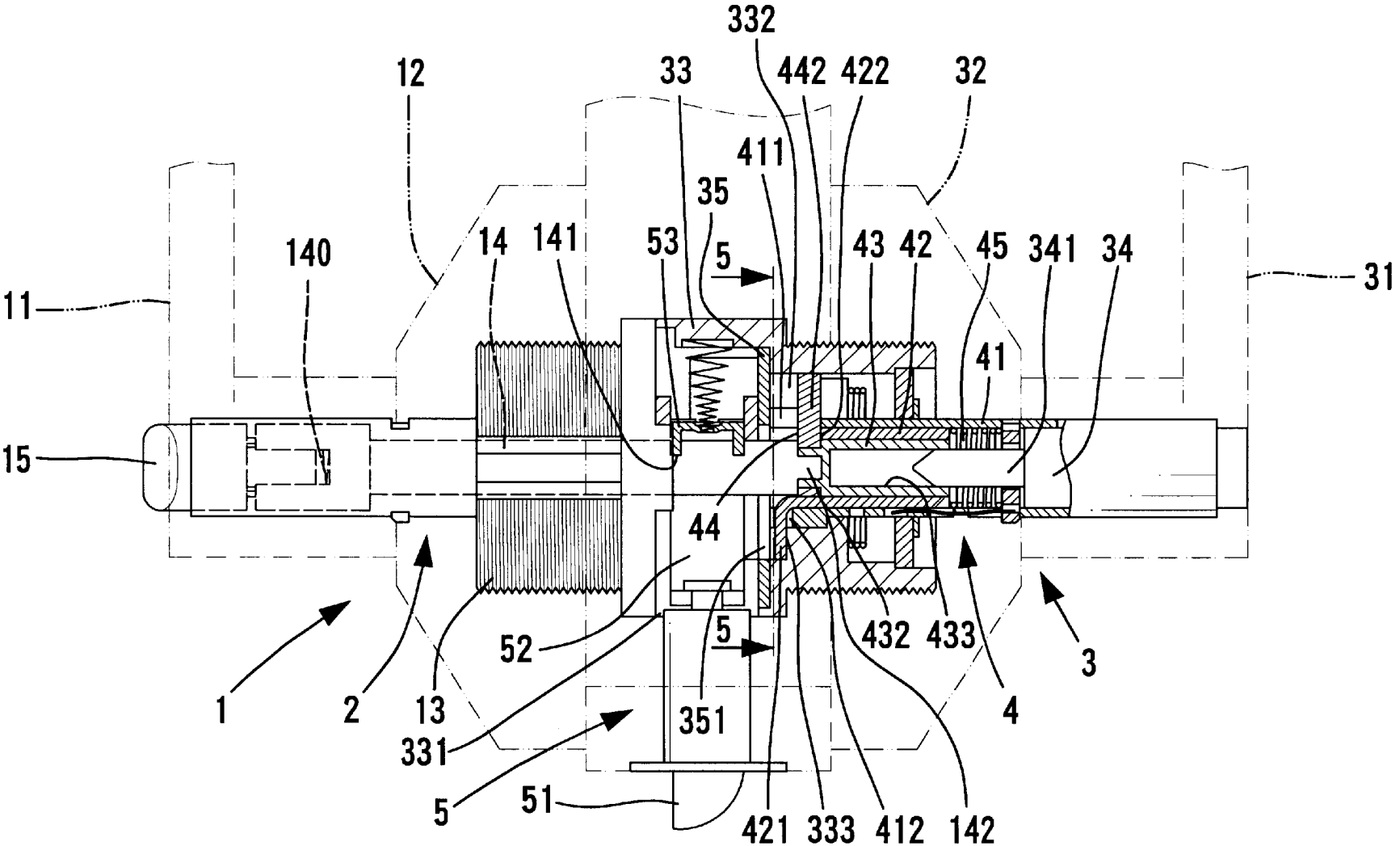
FIG. 4 is a sectional view similar to FIG. 2, wherein the lock is in a locked state.

The inside handle assembly 1 includes an inside handle (e.g., a lever 11) and an inside rose assembly 12 mounted to an end of the inside lever 11. The inside spindle 2 is mounted to an inside hub 13 that is mounted to an inner side of the inside rose assembly 12. The outside handle assembly 3 includes an outside handle (e.g., a lever 31) and an outside rose assembly 32 mounted to an end of the outside lever 31. The outside transmission assembly 4 is mounted to an outside hub 33 that is mounted to an inner side of the outside rose assembly 32. The outside hub 33 and the inside hub 13 are connected together by fasteners 60. A locking bar 14 extends through the inside spindle 2 and is movable along a longitudinal direction of the inside spindle 2. A push button 15 is attached to an end of the locking bar 14 and exposed outside the inside lever 11, as shown in FIG. 4.

A cylinder 34 is mounted in a shank 310 of the outer lever 31 and has a cylinder bar 341 protruding therefrom. A seat 35 is securely mounted in the outside hub 33 for positioning the outer transmission assembly 4. The latch mechanism 5 is mounted in the outside hub 33 and operably connected to the inner spindle 2 and the outer transmission assembly 4. The latch mechanism 5 includes a latch 51 that extends out of the outside hub 33 via a notch 331 of the outside hub 33. The latch 51 is retactable by a retractor 52, and a catch 53 is movably received in the retractor 52.

Figure 2:
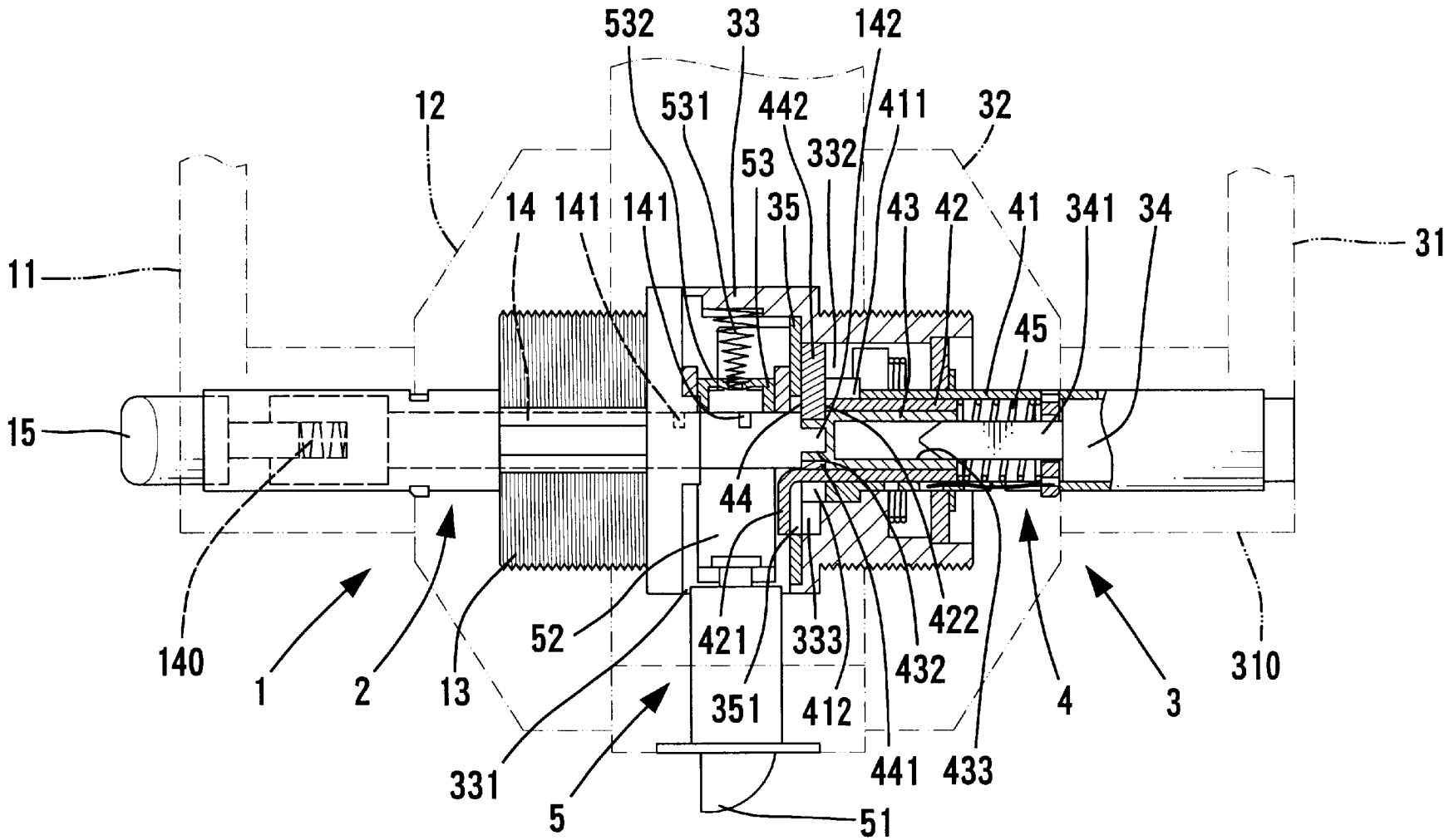
FIG. 2 is a sectional view of the lock in accordance with the present invention, wherein the lock is in an unlocked state.
Figure 3:
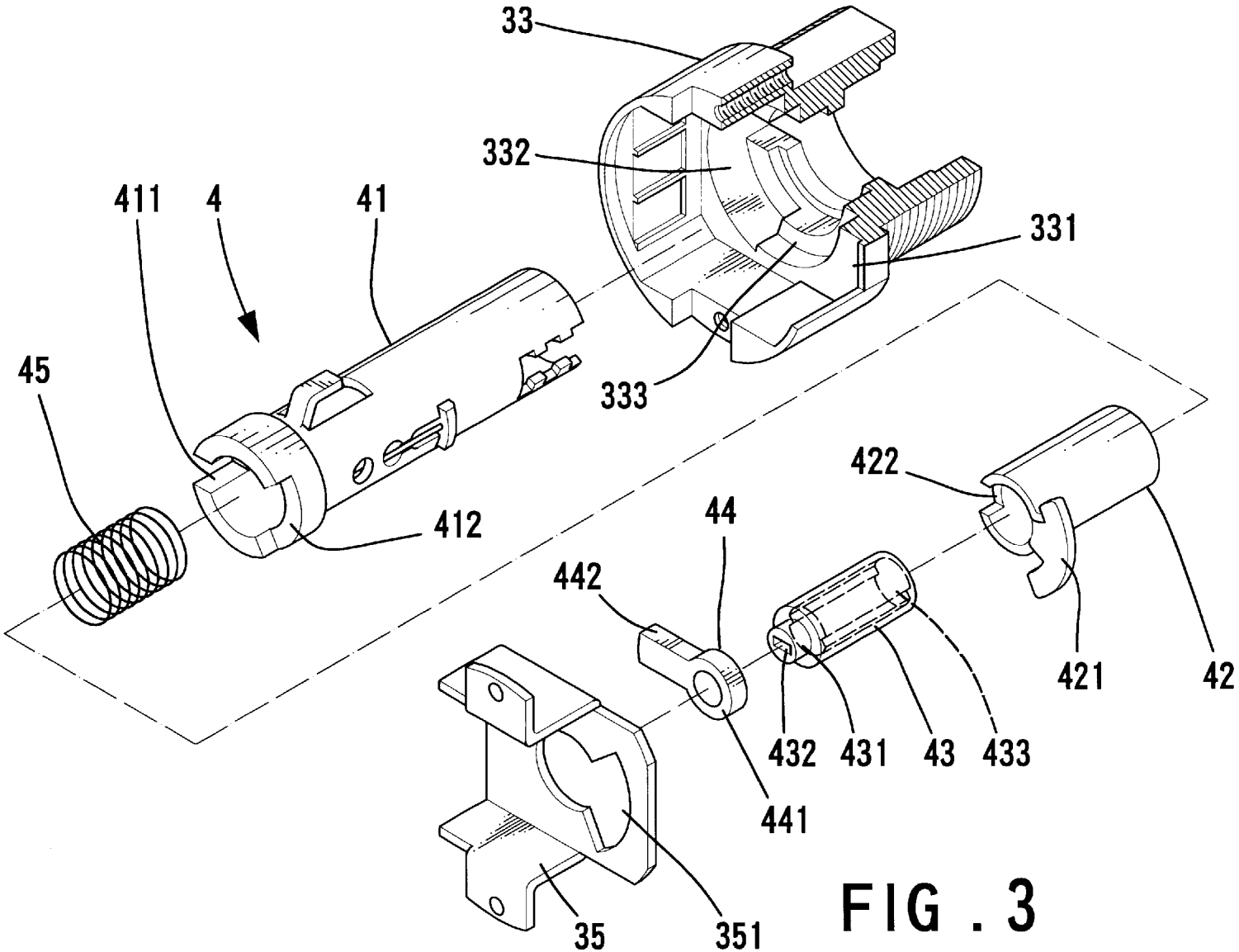
FIG. 3 is an exploded perspective view of a clutch mechanism of the lock in accordance with the present invention.

Referring to FIGS. 2 and 3, the outer transmission assembly 4 includes an outside spindle 41 having a first end received in the outside hub 33 and a second end fixed to the outside lever 31 to turn therewith. The outer transmission assembly 4 further includes a cam 42 received in the first end of the outer spindle 41, a sleeve 43 received in the cam 42, and a lug 44.

The first end of the outside spindle 41 includes a slot 411 defined in a periphery thereof and extending along a longitudinal direction of the outside spindle 41. The first end of the outside spindle 41 further includes a notch 412 defined in the periphery thereof. An elastic element 45 is mounted in the second end of the outside spindle 41 and around the cylinder bar 341, with two ends of the elastic element 45 being attached between an end of the cylinder 34 and the cam 42. The outside hub 33 includes a restraining recessed portion 332 and a groove 333 that are respectively in association with the slot 411 and the notch 412 of the outside spindle 41, which will be described later.

The cam 42 includes an ear 421 projecting radially outward from a periphery thereof and an engaging notch 422 defined in the periphery thereof. Preferably, the ear 421 is diametrically opposed to the engaging notch 422. As illustrated in FIG. 2, the cam 42 is biased by the elastic element 45 such that the ear 421 of the cam 42 is normally engaged with the retractor 52 when the lock is in an unlocked state.

Still referring to FIGS. 1 through 3, the sleeve 43 includes a slot 432 in an end face of an end 431 thereof, and a receptacle 433 is defined in the other end of the sleeve 43. The lug 44 includes an arm 442 and a ring 441 formed on an end of the arm 442. The ring 441 is pivotally mounted around the end 431 of the sleeve 43. The other end 142 of the locking bar 14 is securely engaged in the slot 432 of the end 431 of the sleeve 43, allowing joint movement (including longitudinal movement and rotational movement) of the locking bar 14 and the sleeve 43. The cylinder bar 341 of the cylinder 34 is securely engaged in the receptacle 433 of the sleeve 43, allowing joint rotation of the cylinder bar 341 and the sleeve 43. The arm 442 of the lug 44 extends through the engaging notch 422 of the cam 42 and the slot 411 of the outside spindle 41.

In assembly, as illustrated in FIG. 2, the engaging notch 422 of the cam 42 is aligned with the slot 411 of the outside spindle 41 to allow the arm 442 of the lug 44 to extend through the engaging notch 422 of the cam 42 and the slot 411 of the outside spindle 41. Thus, the sleeve 43 and the cam 42 may move jointly along a longitudinal direction of the outside spindle 41, And the cam 42 and the outside spindle 41 may turn jointly. Further, the arm 442 of the lug 44 extends into the restraining recessed portion 332 of the outside hub 33. The ear 421 of the cam 42 extends through an opening 351 of the seat 35 and is operably connected to the retractor 52.

Still referring to FIG. 2, when the lock is in an unlocked state and when the outside lever 31 is turned, the outside spindle 41 turns together with the outside lever 31. Since the arm 442 of the lug 44 extends through the slot 411 of the outside spindle 41 and the engaging notch 422 of the cam 42, the cam 42 is also turned and thus actuates the retractor 52, causing retraction of the latch 51 and thus allowing opening of the door to which the lock is mounted. Since the ring 441 of the lug 44 is pivotally mounted around the end 431 of the sleeve 43, the sleeve 43 is not turned when the outside spindle 41 is turned. The latch 51 returns to its initial position when the outside lever 31 is released.

Referring to FIG. 4, when the push button 15 is pushed, the lolling bar 14 is moved inward until two side walls 530 of the catch 53 are respectively engaged in two engaging notches 141 on the locking bar 14 under the action of a spring 531 attached between the outside hub 33 and a connecting wall 532 between the side walls 530 of the catch 53. Since the other end 142 of the locking bar 14 is securely engaged in the slot 432 of the end 431 of the sleeve 43, inward movement of the locking bar 14 also causes the sleeve 43 and the lug 44 to move away from the retractor 52. Thus, the ear 421 of the cam 42 passes trough the opening 351 of the seat 35 and is thus disengaged from the retractor 52. The ear 421 of the cam 42 is moved to the notch 412 of the outside spindle 41 and the groove 333 of the outside hub 33.

Figure 5:
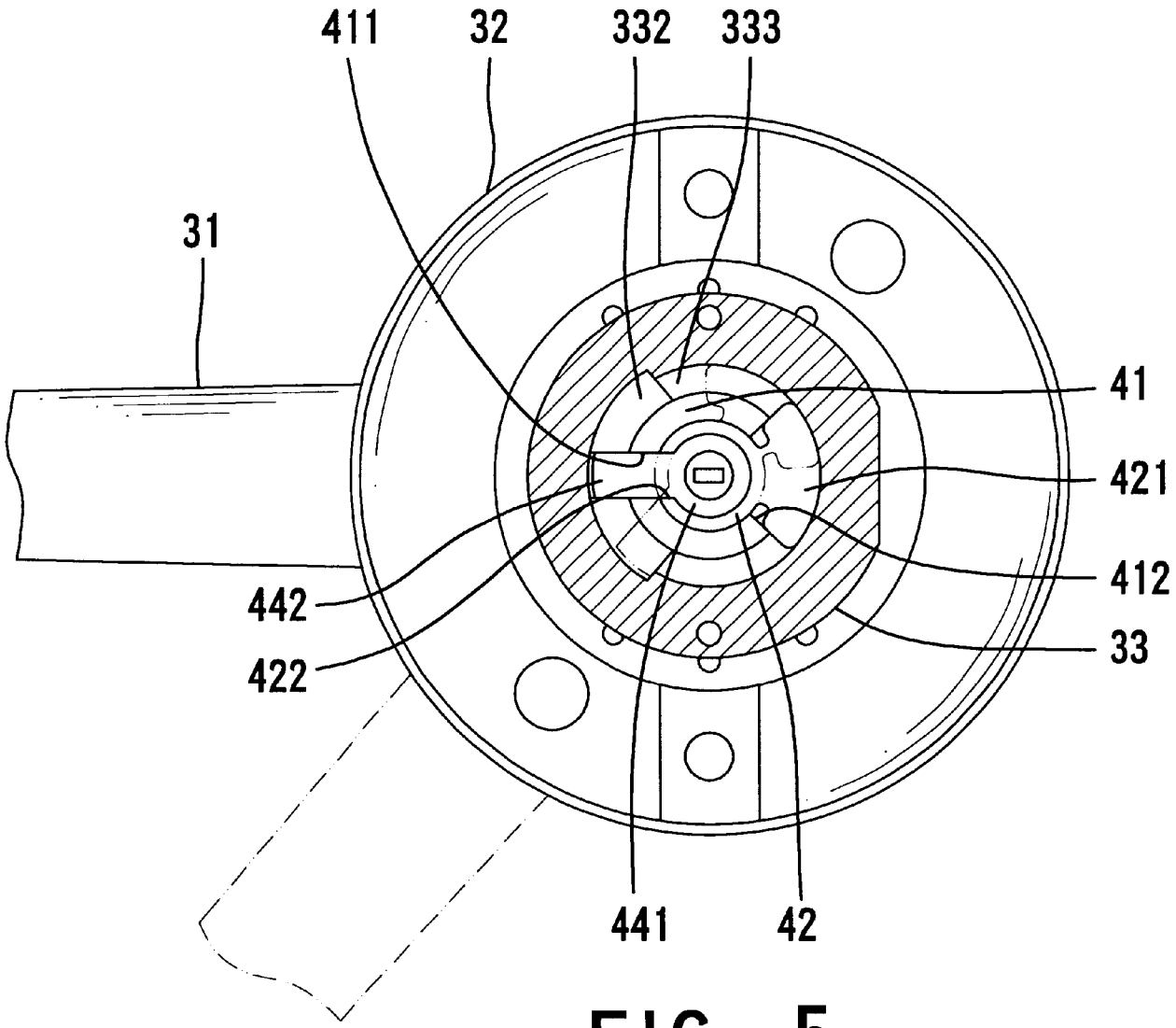
FIG. 5 is a sectional view taken along plane 5—5 in FIG. 4, illustrating free rotation of the outer handle when the lock is in the locked state.

Referring to FIG. 5, when the outside lever 31 is turned while the lock is in the locked state shown in FIG. 4, since the ear 421 of the cam 42 is disengaged from the retractor 52, the outside lever 31 turns freely without causing retraction of the latch 51. Thus, damage to the inner parts of the lock resulting from turning of the outside lever 31 while the lock is in the locked state is avoided. The maximum pivotal movement of the outside lever 31 is generally 45 degrees, and it is determined by the arcuate length of the restraining recessed portion 332 of the outside hub 33 that receives the arm 442 of the lug 44. Namely, when the outside lever 31 is turned, movement of the arm 442 of the lug 44 is limited by two ends of the restraining recessed portion 332 of the outside hub 33. Further, the groove 333 of the outside hub 33 has an appropriate arcuate length to allow the ear 421 of the lug 44 to turn through a predetermined angle in the outside hub 33 and to allow longitudinal movement of the ear 421. Further, the depths of the slot 411 of the outside spindle 41 and the raining recessed portion 332 of the outside hub 33 allow longitudinal movement of the arm 442 away from the outside hub 33.

Figure 6:
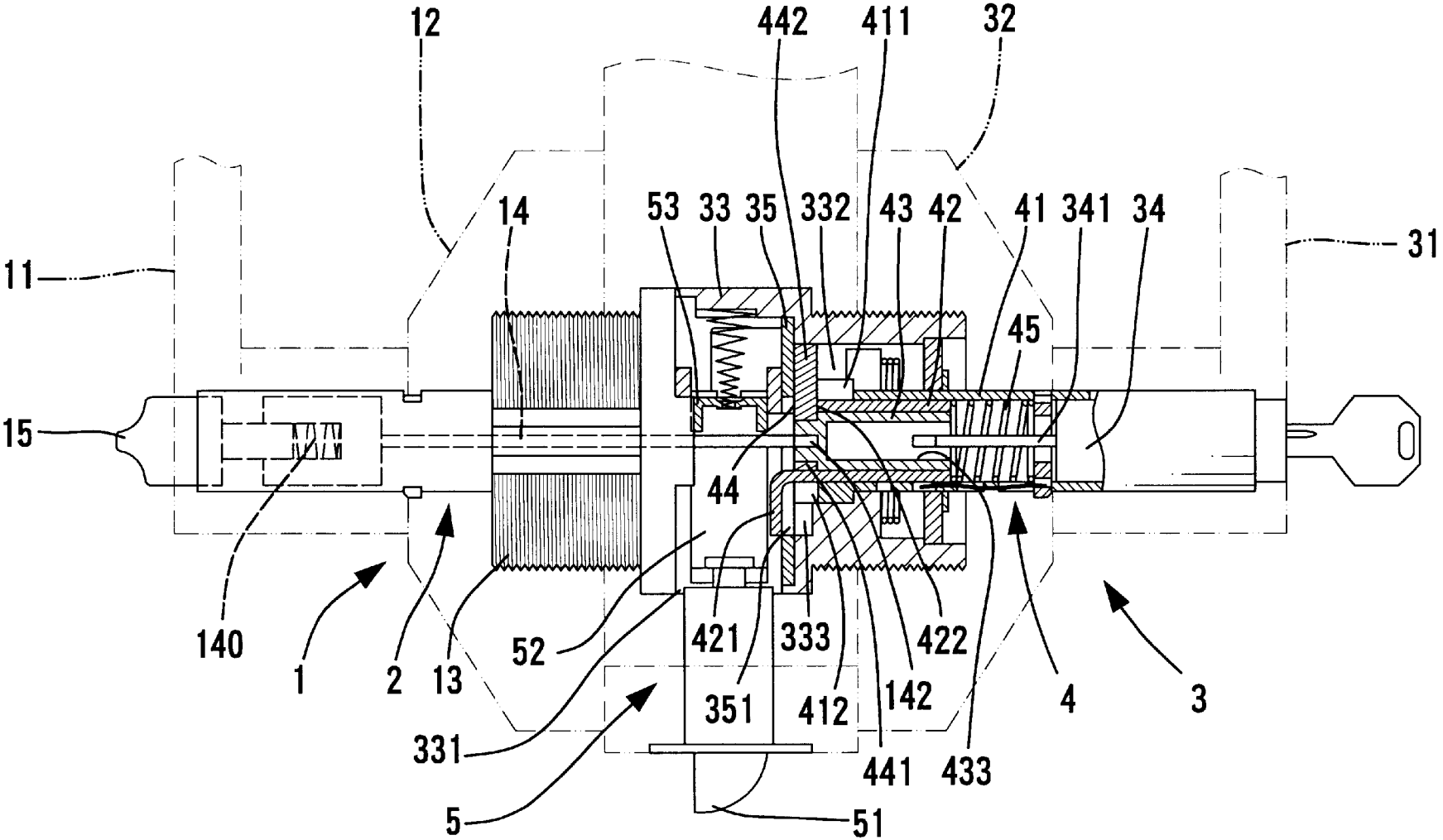
FIG. 6 is a sectional view similar to FIG. 4, illustrating unlocking operation by a key.

Referring to FIG. 6, when a proper key (not labeled) is inserted into the cylinder 34 and turned through a predetermined angle, the sleeve 43 is turned, as the cylinder bar 341 of the cylinder 34 is securely engaged in the receptacle 433 of the sleeve 43. The locking bar 14 is also turned, as the other end 142 of the locking bar 14 is securely engaged in the slot 432 of the end 431 of the sleeve 43. Thus, the engaging notches 141 (FIG. 2) of the locking bar 14 are disengaged from the side walls 530 of the catch 53. The lock is no longer in the locked state, as the locking bar 14 returns to its initial position shown in FIG. 2 under the action of a return spring 140. The sleeve 43, the lug 44, and the cam 42 return to their initial position shown in FIG. 2 under the action of the elastic element 45.

According to the above description, it is appreciated that the outer transmission assembly 4 in accordance with the present invention provides a clutch mechanism that allows easy assembly and that is easy to manufacture while allowing the outer handle to rotate freely when the lock is in a locked state so that the internal parts of the lock will not be damaged.

Although the invention has been explained in relation to its preferred embodiment, it is to be understood that many other possible modifications and variations can be made without departing from the scope of the invention as hereinafter claimed.

What is claimed is:

1. A lock comprising:

a latch;

a retractor for retracting the latch;

an inside handle;

an inside spindle having a first end fixed to the inside handle to turn therewith and a second end, the inside spindle being operably connected to the retractor such that rotation of the inside spindle causes retraction of the latch;

a locking bar extending through the inside spindle and having a first end and a second end;

an inside hub for rotatably receiving the second end of the inside spindle;

an outside handle;

an outside spindle having a first end and a second end fixed to the outside handle to turn therewith, the first end of the outside spindle including a slot extending along a longitudinal direction of the outside spindle;

an outside hub for rotatably receiving the first end of the outside spindle;

a cam received in the first end of the outside spindle, the cam being movable relative to the outside spindle along a longitudinal direction of the outside spindle, the cam having an engaging notch, the cam further having an cam projecting outward therefrom, the ear of the cam being releasably engaged with the retractor such that rotation of the cam causes retraction of the latch;

a sleeve received in the cam and having a first end and a second end;

a lug having an arm and a zing formed on an end of the arm, the ring being so mounted to the first end of the sleeve that the sleeve is not turned when the arm is turned and that the arm and the sleeve are jointly movable along the longitudinal direction of the outside spindle, the arm extending through the engaging notch of the cam and the slot of the outside spindle, the cam and the outside spindle being turned jointly when the outside handle is turned; and an elastic element mounted between the outside handle and the cam for biasing the ear of the cam to engage with the retractor;

wherein when the locking bar is moved to a locking position, the lug and the sleeve are moved away from the retractor, the cam is also moved away from the retractor such that the ear of the cam is disengaged from the retractor, allowing free rotation of the outside handle without causing retraction of the latch;

wherein the first end of the sleeve includes a slot defined in an end face thereof for securely receiving the second end of the locking bar.

2. The lock as claimed in claim 1, wherein the outside handle is a lever.

3. The lock as claimed in claim 1, wherein the first end of the locking bar includes a push button mounted thereto, the lock further including a catch mounted in the outside hub, the catch having two side walls and a connecting wall between the side walls, a spring being attached between hem connecting wall of the catch and the outside hub, the locking bar including two engaging notches, the side walls of the catch being engaged with the engaging notches of the locking bar under action of the spring when the locking bar is moved to the locking position.

4. The lock as claimed in claim 3, wherein the second end of the sleeve includes a receptacle, the outside handle includes a cylinder mounted therein, the cylinder including a cylinder bar securely mounted in the receptacle of the sleeve such that the sleeve is turned when a key is inserted into the cylinder and turned, the locking bar being turned to cause the engaging notches of the locking bar to disengage from the side walls of the catch, the sleeve, the lug, and the cam returning to their original position under action of the elastic element.

5. The lock as claimed in claim 1, wherein the outside hub includes a restraining recessed portion allowing movement of the arm along the longitudinal direction of the outside spindle, the restraining recessed portion having two ends for limiting rotational movement of the arm.

6. The lock as claimed in claim 1, wherein the first end of the outside spindle includes a notch for slidingly receiving the ear of the cam.

7. The lock as claimed in claim 6, wherein the outside hub includes a groove for slidingly and rotatably receiving the ear of the cam.

8. The lock as claimed in claim 1, wherein the lock further includes a seat securely mounted in the outside hub for retaining the sleeve, the cam, and the lug.

9. The lock as claimed in claim 8, wherein the seat includes an opening through which the ear of the cam is passable.

10. A lock comprising:

a latch;

a retractor for retracting the latch;

an inside handle;

an inside spindle having a first end fixed to the inside handle to turn therewith and a second end, the inside spindle being operably connected to the retractor such that rotation of the inside spindle causes retraction of the latch;

a locking bar extending through the inside spindle and having a first end and a second end;

an inside hub for rotatably receiving the second end of the inside spindle;

an outside handle;

an outside spindle having a the end and a second end fixed to the outside handle to turn therewith, the first end of the outside spindle including a slot extending along a longitudinal direction of the outside spindle;

an outside hub for rotatably receiving the first end of the outside spindle;

a cam received in the first end of the outside spindle, the cam being movable relative to the outside spindle alone a longitudinal direction of the outside spindle, the cam having an engaging notch, the cam further having an ear projecting outward therefrom, the ear of the cam being releasably engaged with the retractor such that rotation of the cam causes retraction of the latch;

a sleeve received in the cam and having a first end and a second end;

a lug having an arm and a ring formed on an end of the arm, the ring being so mounted to the first end of the sleeve that the sleeve is not turned when the arm is turned and that the arm and the sleeve are jointly movable along the longitudinal direction of the outside spindle, the arm extending through the engaging notch of the cam and the slot of the outside spindle, the cam and the outside spindle being turned jointly when the outside handle is turned; and an elastic element mounted between the outside handle and the cam for biasing the ear of the cam to engage with the retractor;

wherein when the locking bar is moved to a locking position, the lug and the sleeve are moved away from the retractor, the cam is also moved away from the retractor such that the ear of the cam is disengaged from the retractor, allowing free rotation of the outside handle without causing retraction of the latch;

wherein the first end of the outside spindle includes a notch for slidingly receiving the ear of the cam.

11. The lock as claimed in claim 10, wherein the outside hub includes a groove for slidingly and rotatably receiving the ear of the cam.

12. The lock as claimed in claim 10, wherein the first end of the locking bar includes a push button mounted thereto, the lock further including a catch mounted in the outside hub, the catch having two side walls and a connecting wall between the side walls, a spring being attached between the connecting wall of the catch and the outside hub, the locking bar including two engaging notches, the side walls of the catch being engaged with the engaging notches of the locking bar under action of the spring when the locking bar is moved to the locking position.

13. The lock as claimed in claim 12, wherein the second end of the sleeve includes a receptacle, the outside handle includes a cylinder mounted therein, the cylinder including a cylinder bar securely mounted in the receptacle of the sleeve such that the sleeve is turned when a key is inserted into the cylinder and turned, the locking bar being turned to cause the engaging notches of the locking bar to disengage from the side walls of the catch, the sleeve, the lug, and the cam return to their original position under action of the elastic element.

14. The lock as claimed in claim 10, wherein the outside hub includes a restraining recessed portion allowing movement of the arm along the longitudinal direction of the outside spindle, the restraining recessed portion having two ends for limiting rotational movement of the arm.

15. The lock as claimed in claim 10, wherein the lock further includes a seat securely mounted in the outside hub for retaining the sleeve, the cam, and the lug.

16. The lock as claimed in claim 15, wherein the seat includes an opening through which the ear of the cam is passable.

17. The lock as claimed in claim 12, wherein the first end of the locking bar includes a push button mounted thereto, the lock further including a catch mounted in the outside hub, the catch having two side walls and a connecting wall between the side walls, a spring being attached between the connecting wall of the catch and the outside hub, the locking bar including two engaging notches, the side walls of the catch being engaged with the engaging notches of the locking bar under action of the spring when the locking bar, is moved to the locking position.

18. The lock as claimed in claim 17, wherein the second end of the sleeve includes a receptacle, the outside handle includes a cylinder mounted therein, the cylinder including a cylinder bar securely mounted in the receptacle of the sleeve such that the sleeve is turned when a key is inserted into the cylinder and turned, the locking bar being turned to cause the engaging notches of the locking bar to disengage from the side walls of the catch, the sleeve, the lug, and the cam returning to their original position under action of the elastic element.

19. A lock comprising:

a latch;

a retractor for retracting the latch;

an inside handle;

an inside spindle having a first end fixed to the inside handle to turn therewith and a second end, the inside spindle being operably connected to the retractor such that rotation of the inside spindle causes retraction of the latch;

a locking bar extending through the inside spindle and having a first end and a second end;

an inside hub for rotatably receiving the second end of the inside spindle;

an outside handle;

an outside spindle having a first end and a second end fixed to the outside handle to turn therewith, the first end of the outside spindle including a slot extending along a longitudinal direction of the outside spindle;

an outside hub for rotatably receiving the first end of the outside spindle;

a cam received in the first end of the outside spindle, the cam being movable relative to the outside spindle along a longitudinal direction of the outside spindle, the cam having an engaging notch, the cam further having an ear projecting outward therefrom, the ear of the cam being releasably enraged with the retractor such that rotation of the cam causes retraction of the latch;

a sleeve received in the cam and having a first end and a second end;

a lug having an arm and a ring formed on an end of the arm, the ring being so mounted to the first end of the sleeve that the sleeve is not turned when the arm is turned and that the arm and the sleeve are jointly movable along the longitudinal direction of the outside spindle, the arm extending through the engaging notch of the cam and the slot of the outside spindle, the cam and the outside spindle being turned jointly when the outside handle is turned; and an elastic element mounted between the outside handle and the cam for biasing the ear of the cam to engage with the retractor;

wherein when the locking bar is moved to a locking position, the lug and the sleeve are moved away from the retractor, the cam is also moved away from the retractor such that the ear of the cam is disengaged from the retractor, allowing free rotation of the outside handle without causing retraction of the latch;

wherein the lock further includes a seat securely mounted in the outside hub for retaining the sleeve, the cam, and the lug; and wherein the seat includes an opening through which the ear of the cam is passable.

* * * * *